United States Patent [19]

Barnes

[11] Patent Number: 4,649,905

[45] Date of Patent: Mar. 17, 1987

[54] CERVICALLY ADJUSTABLE CHIROPRACTIC TREATMENT TABLE

[76] Inventor: James E. Barnes, 4410 Arden Dr., Fort Wayne, Ind. 46804

[21] Appl. No.: 667,340

[22] Filed: Nov. 1, 1984

[51] Int. Cl.[4] ..... A61H 1/02

[52] U.S. Cl. ..... 128/74; 128/70

[58] Field of Search ..... 128/70, 71, 72, 73, 128/74, 75, 69; 269/323, 324, 325, 326

[56] References Cited

U.S. PATENT DOCUMENTS

| | | | |
|---|---|---|---|
| 1,145,503 | 7/1915 | Naysmith | 128/73 |
| 1,286,166 | 11/1918 | Albright | 128/74 |
| 1,314,597 | 9/1919 | Koenigkramer | 128/74 |
| 1,351,482 | 8/1920 | McManis | 128/74 |
| 1,417,675 | 5/1922 | McManis | 128/74 |
| 1,453,013 | 4/1923 | Koenigkramer | 128/74 |
| 1,936,363 | 11/1933 | Murray | 128/74 |
| 2,002,349 | 5/1935 | Lundeen | 128/72 |
| 2,179,595 | 11/1939 | McManis | 128/72 |
| 2,208,502 | 7/1940 | Kjelgaard | 128/72 |
| 2,236,770 | 4/1941 | Atwell | 128/72 |
| 3,226,106 | 12/1965 | Johnson et al. | 269/325 |
| 3,473,024 | 10/1969 | Feiertag | 269/323 |
| 3,941,365 | 3/1976 | Frymoyer | 269/325 |
| 4,445,504 | 5/1984 | Barge | 128/70 |
| 4,489,714 | 12/1984 | Barnes | 128/70 |
| 4,523,581 | 6/1985 | Ekholm | 269/323 |

FOREIGN PATENT DOCUMENTS

| | | | |
|---|---|---|---|
| 16692 | of 1913 | France | 269/324 |
| 505030 | 7/1920 | France | 269/324 |
| 544618 | 9/1922 | France | 269/323 |
| 1105177 | 11/1955 | France | 269/323 |

OTHER PUBLICATIONS

"Chiro-Manis", *The Quality Name in Chiropractic Tables,* advertising brochure.

*Primary Examiner*—Clifford D. Crowder

*Attorney, Agent, or Firm*—Pearne, Gordon, McCoy & Granger

[57] ABSTRACT

A unique headpiece and headpiece coupling arrangement to be used in conjunction with a chiropractic treatment table, allowing the practitioner to select any one or more of five different modes of movement of the headrest relative to the main portion of the treatment table is disclosed. In addition to the somewhat conventional pivotal motion about a horizontal axis the present invention provides the practitioner with pivotal motion about a vertical axis, linear extension or traction, rotation of the headpiece about a longitudinal axis coinciding with the patient's spinal column and an abrupt limited motion for bringing a patient's head forward and downwardly, imparting a snapping action to the cervical spine portion.

18 Claims, 15 Drawing Figures

CERVICALLY ADJUSTABLE CHIROPRACTIC TREATMENT TABLE

SUMMARY OF THE INVENTION

The present invention relates generally to chiropractic treatment tables of the type for generally horizontally supporting a patient in a facedown position and, more particularly, to such tables having a wide latitude of variability in orienting and moving the cervical portion of the patient's spine. With such an arrangement a chiropractor or other practitioner can select appropriate positions and motions tailored to the particular patient's disorder of the cervical curve portion of the spinal column.

The treatment of various maladies of the human body by means of the manipulation of the muscles and skeletal structure thereof, commonly referred to as chiropracty, has become a widely used and accepted art. Various apparatuses have been developed to facilitate this type of treatment, one such apparatus being an articulated treatment table. Such tables, such as, for example, the "Barnes Flexion-Distraction" manufactured by Custom Tool, Inc., typically include an elongated, padded platform or table on which a patient can recline. The table is further provided with means for securing the patient's extremities, e.g., the patient's ankles, and includes an articulated lower or anterior body section which underlies the patient adjacent the lower back. The table provides means for tiltably raising and lowering (extension and flexion, respectively), laterally bending, rotating and extending the anterior body section with respect to the upper body or support section. Such treatment tables have proven to be valuable aids to the practitioner of chiropractic medicine and various treatments for patients suffering from spinal and related nerve, muscle and skeletal maladies have been devised using such tables. Among the many options available on the tables manufactured by the assignee of the present invention have been power driven or automated arrangements for moving the anterior body section with respect to the upper body support as illustrated in copending U.S. patent application Ser. No. 456,511, (U.S. Pat. No. 4,489,714), and arrangements for tilting about a transverse horizontal axis a headrest segment of the upper body support section of the table. Such tilting of a headrest about a transverse horizontal axis is also illustrated in U.S. Pat. No. 1,938,006.

Each of the aforementioned arrangements for tilting or pivoting the headrest portion of a chiropractic table relative to the main support arrangement of that table have been limited to a single degree of freedom, namely pivotal motion of the headrest about a transverse horizontal axis, generally separating that headrest portion from the main body of the table. Such a pivotal motion is highly desirable in treating certain disorders of the cervical portion of the spine; however, it is frequently desirable for the practitioner to be able to move the spinal column cervical portion in other than a simple forward tipping motion, and with these prior treatment tables, such other motions could only be accomplished by the doctor physically moving the patient's head relative to the head support portion of the table. It would be highly desirable for the practitioner to have a wider variety of table head support motions available to him.

In general and in one form of the invention, a patient having a disorder of the cervical curve portion of the spinal column may be treated by supporting the patient in a generally horizontal, facedown attitude on a chiropractic treatment table, with the patient's body resting on a first table portion, such as a body support section and the patient's head resting on a second table portion, such as a headpiece, which is selectively movable relative to the first table portion and thereafter the practitioner simultaneously moves the patient's head and the table headpiece relative to the patient's body and the first table portion in a manner so that the head and body continuously remain in contact with the respective table portions and with that movement including one or more of the following motions:

rotation or pivotal motion about a horizontal, longitudinal axis passing lengthwise along the patient and through a cervical portion of the patient's spine, thus allowing a twisting motion from side to side to be imparted to the patient's head;

rotation or pivotal motion about a generally vertical axis extending generally perpendicular to and through a cervical portion of the patient's spine, thus allowing a lateral flexion or side to side head motion in a generally horizontal plane;

a tilting forward and backward or vertical flexion of the patient's head by pivotal motion of the head support section about a generally horizontal transverse axis, which was heretofore the only motion available with the above-noted prior art devices;

a linear translation to stretch a cervical portion of the patient's spine to induce a traction in the cervical spine portion; and a snap action or drop wherein the headpiece executes an abrupt oblique linear translation downward and away from the main body support section of the table imparting a stretching and forward snapping action to a cervical portion of the patient's spine.

Also in general and in one form of the invention, an improved mechanical coupling between head and body support sections of a chiropractic treatment table, selectively allows between those body support sections limited rotational movement about a longitudinal axis located above the mechanically coupled support sections and in general alignment with a patient's spine. The mechanical coupling may include an elongated support bar, articulately coupled near one end thereof to the body support section of the table and a pair of arcuate rails fixed to the head support section and relatively movable along a pair of rail receiving fixtures on the support bar. The rails are formed in the general configuration of portions of circles, the centers of which coincide with the longitudinal axis and the rail receiving fixtures may include a plurality of rail engaging rollers along with a manually actuable clamp for selectively securing the rail section to the fixture at a preferred rotational orientation of the head support section relative to the body support section. The head support, arcuate rails and fixtures may be longitudinally movable along the support bar and the support bar articulately coupled to the body support section to provide desired traction, vertical flexion and lateral flexion of a patient's cervical spine portion. The head support section may also be abruptly translated through a limited distance obliquely downward and away from the body support section due to the presence of a sliding interconnection forming part of the articulate coupling.

A number of the objects and advantageous features of the present invention can now be noted, including the provision of an articulated headpiece for a chiropractic treatment table; the provision of a chiropractic treatment table of sufficient versatility to meet virtually every treatment need; the provision of a chiropractic treatment table having five (5) degrees of freedom of movement relative to the remaining table portion; the provision of a headrest arrangement upon which a patient may rest his head continuously even though the relative position and orientation of that headrest is being changed by a practitioner; and overall improvements in chiropractic treatment techniques. These as well as other objects and advantageous features of the present invention will be in part apparent and in part pointed out in conjunction with the accompanying drawing in which:

Figure 1:
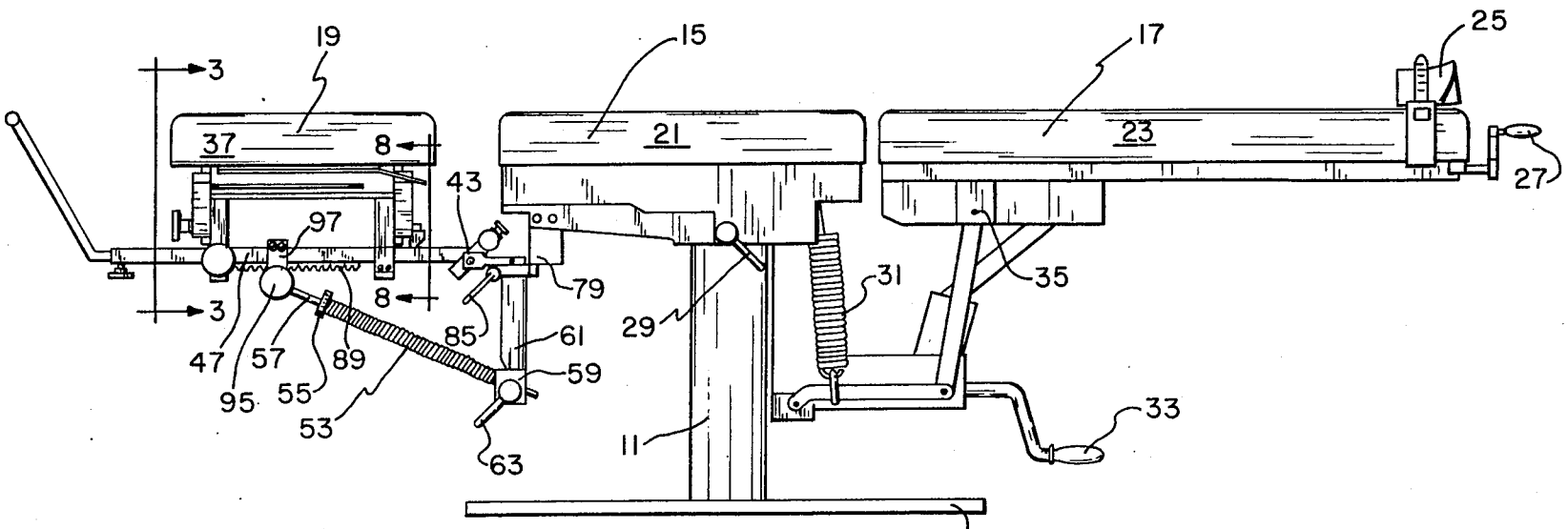
FIG. 1 is a side elevation view of a chiropractic treatment table in accordance with a preferred embodiment of the present invention.
Figure 2C:
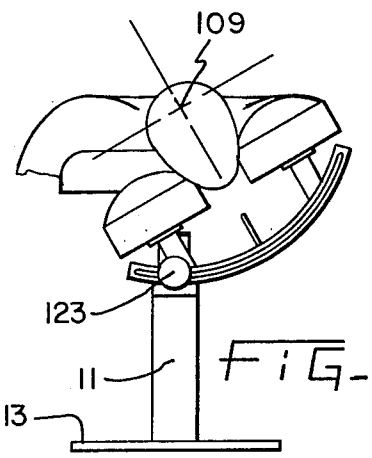
Figure 2B:
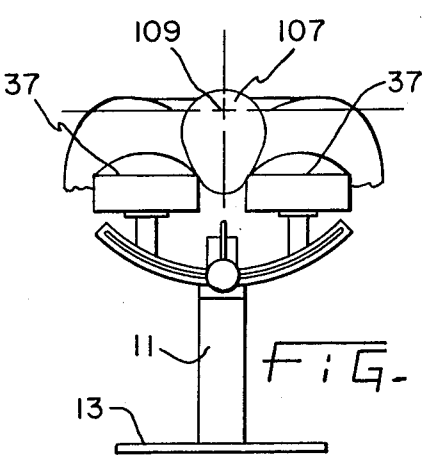
Figure 2A:
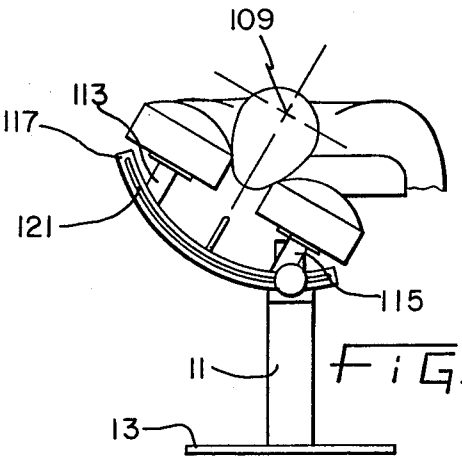
Figure 3:
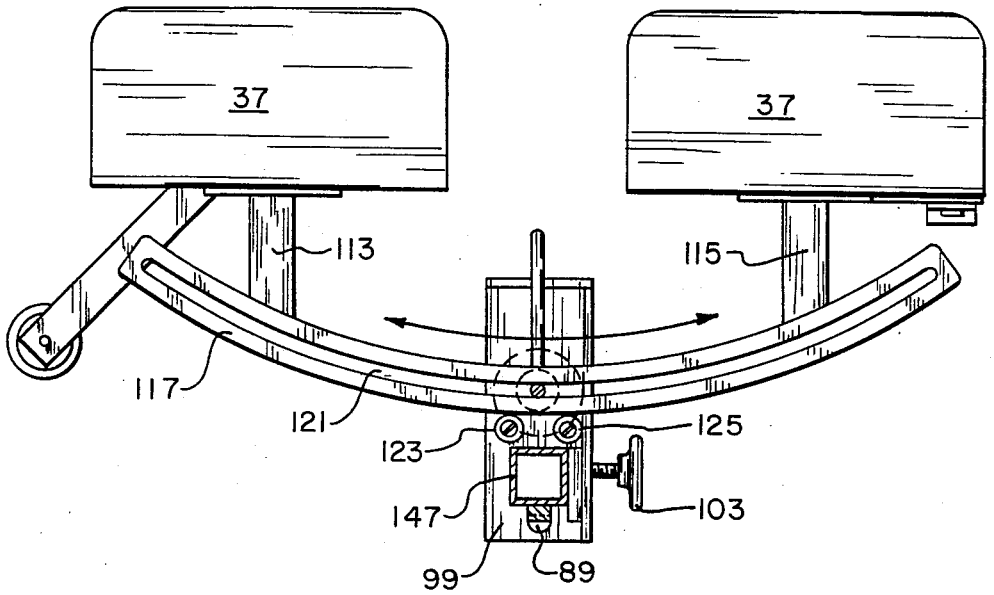

FIGS. *2a, 2b* and *2c* are somewhat simplified end elevation views of a treatment table supporting a patient in each of three different positions;

FIG. 3 is an end elevation view of the headpiece and mechanical coupling facilitating movement between the positions of FIG. 2 taken along lines 3—3 of FIG. 1.

Figure 4:
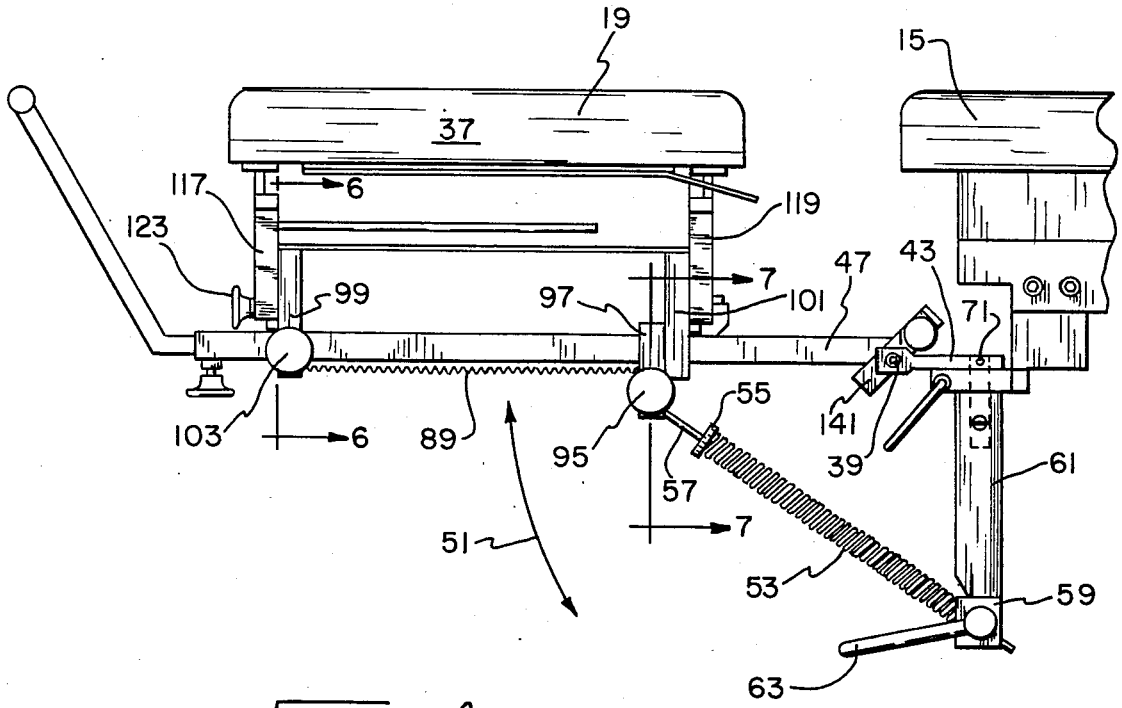
Figure 5:
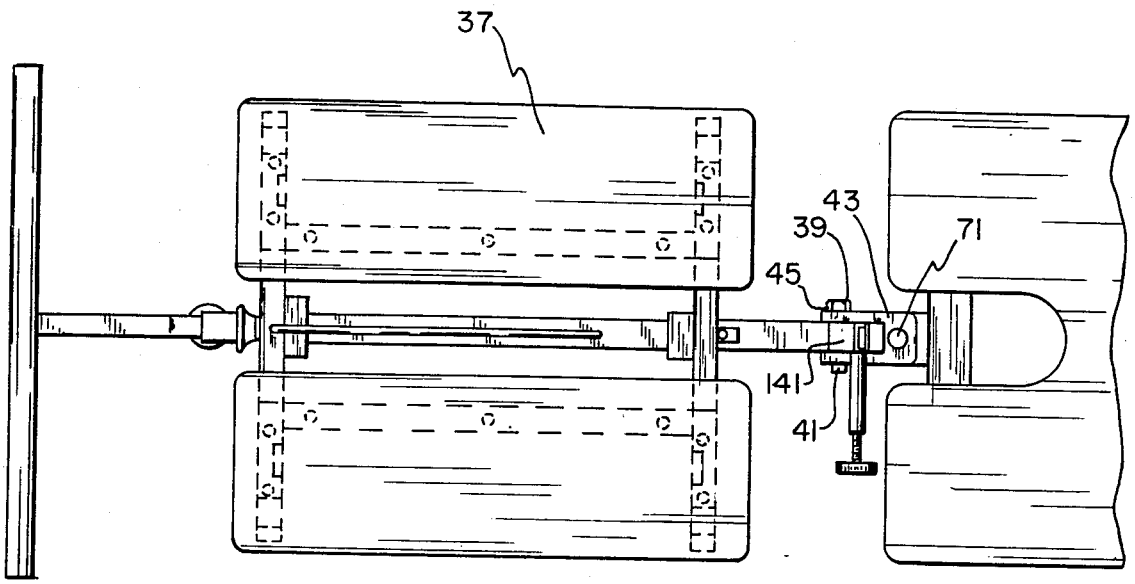
Figure 6:
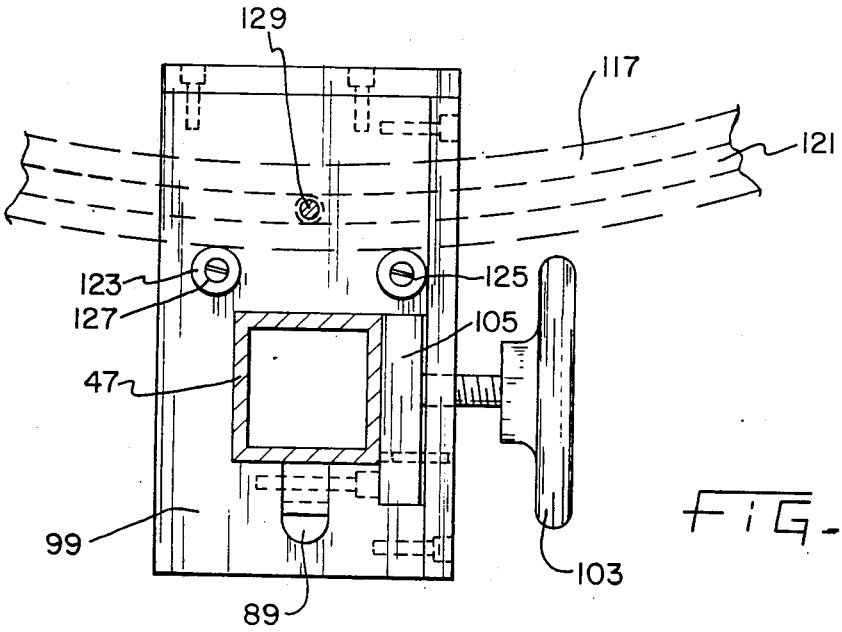
Figure 7:
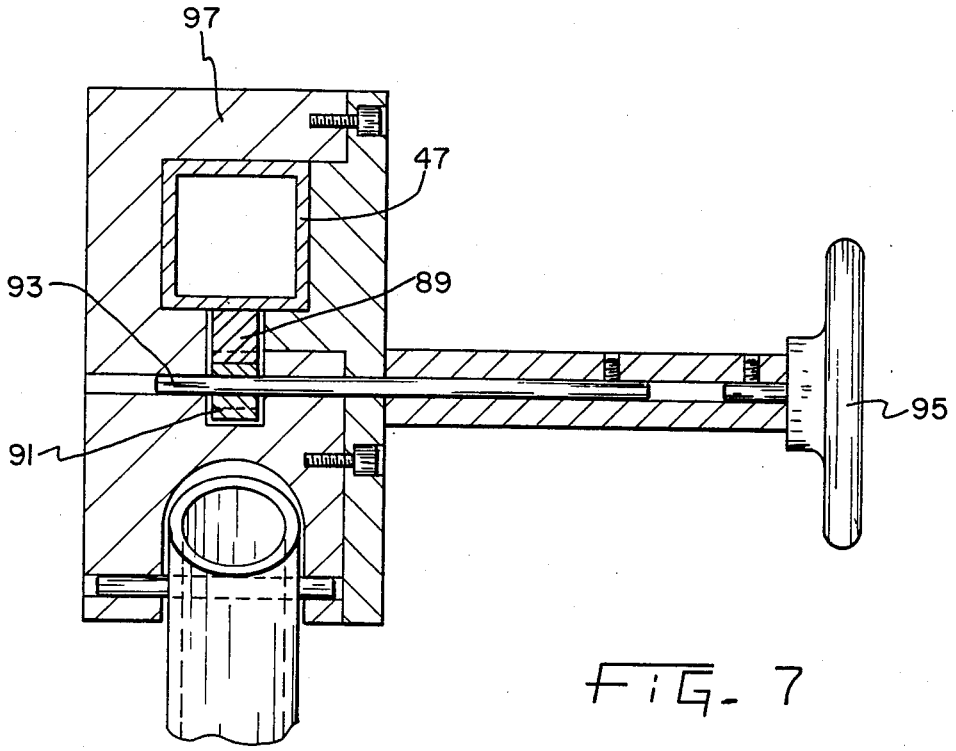
Figure 9:
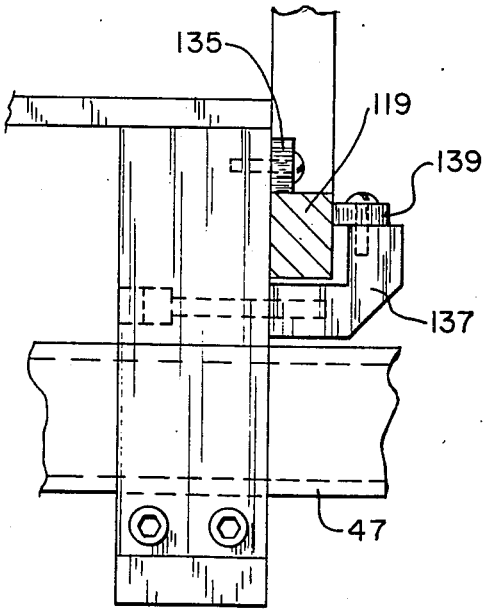
Figure 8:
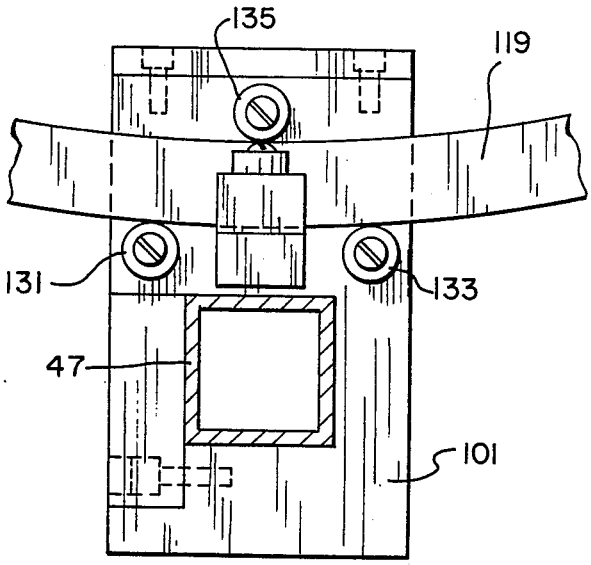
Figure 10:
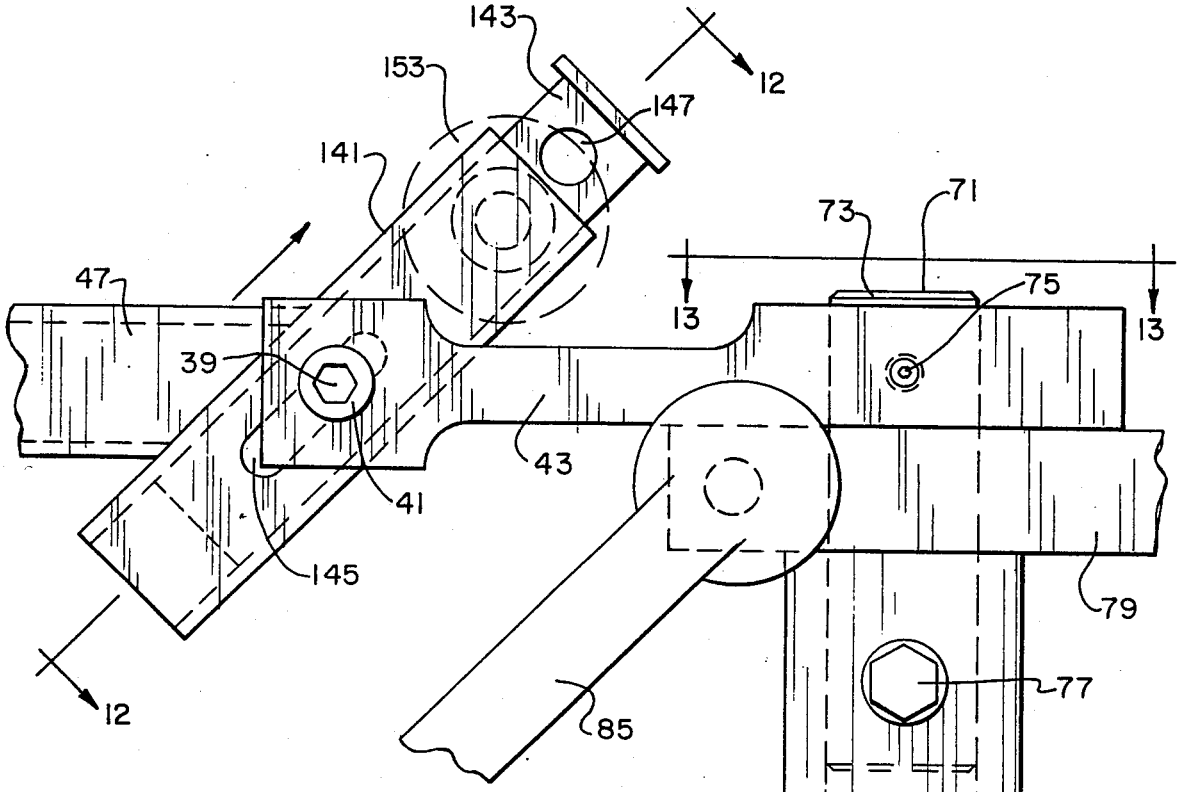
Figure 11:
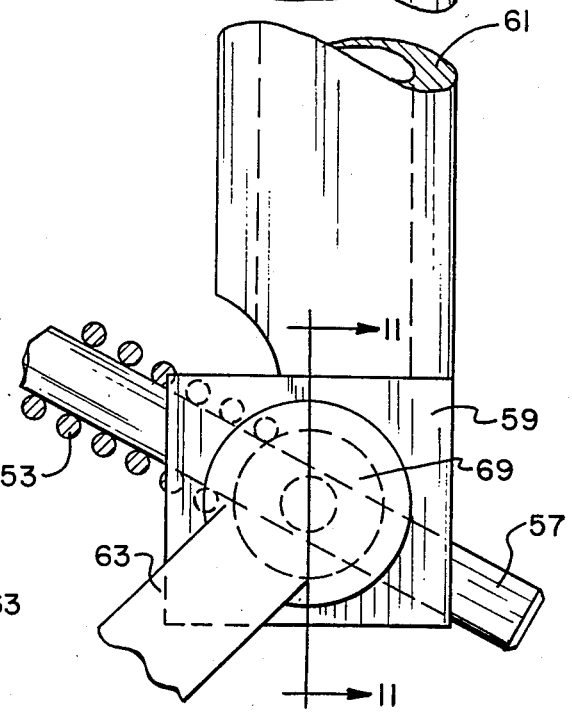
Figure 11:
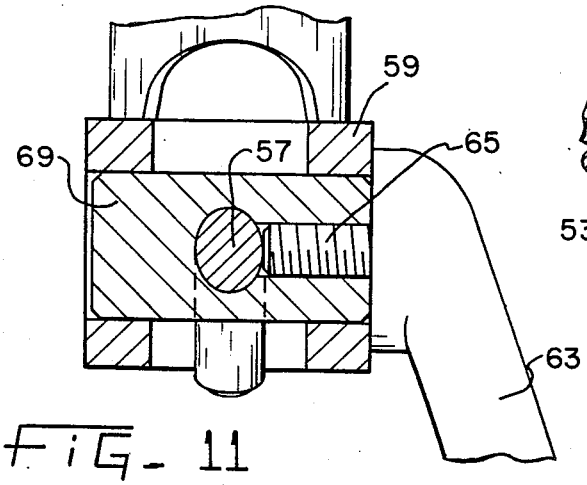
Figure 12:
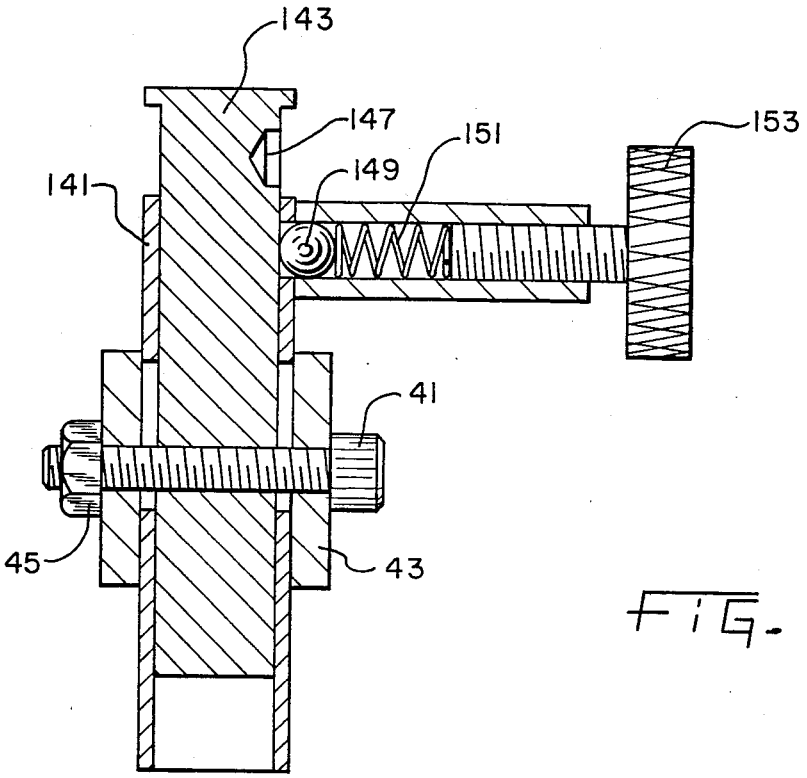
Figure 13:
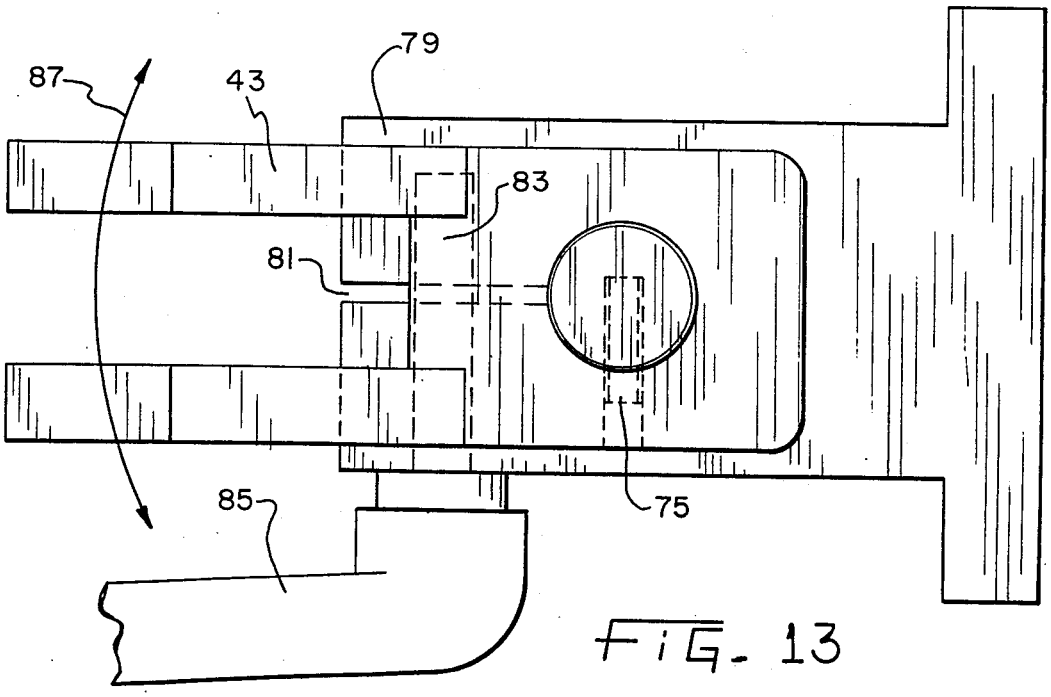

FIG. 4 is a side elevation view of the headpiece and articulate coupling to the treatment body support section;

FIG. 5 is a top view of the structure illustrated in FIG. 4;

FIG. 6 is a view in cross section along lines 6—6 of FIG. 4;

FIG. 7 is a cross sectional view along the lines 7—7 of FIG. 4;

FIG. 8 is a sectional view along lines 8—8 of FIG. 1;

FIG. 9 is a side view of the fixture and rail of FIG. 8 partially in cross section;

FIG. 10 is a side elevation view illustrating the articulate coupling between the headpiece and main body support portion of the table as illustrated in lesser detail in FIGS. 1, 4 and 5;

FIG. 11 is a cross sectional view along lines 11—11 of FIG. 10;

FIG. 12 is a view in cross section along lines 12—12 of FIG. 10; and FIG. 13 is a view along lines 13—13 of FIG. 10.

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring now to the drawing and in particular to FIG. 1, there is illustrated a chiropractic treatment table incorporating a presently preferred embodiment of the present invention. Generally speaking, the treatment table of FIG. 1 is of the type having a support pedestal 11 resting on a floor engaging base 13 and having an upper body support section 15 resting on the pedestal 11. An anterior body support portion 17 extends from the main body support portion 15 and pedestal 11 toward the right as viewed, while a headpiece or head support portion 19 extends from the upper body support section 15 toward the left as viewed. The upper body support section 15 and anterior portion 17 for supporting a lower portion of the patient's body, as well as the relationship between those two sections, and support pedestal 11 is largely conventional and may, for example, be constructed much as in the aforementioned copending application or the aforementioned known devices. Briefly, the uppermost portions of the upper body support section 15 and anterior support section 17 comprise cushions 21 and 23 upon which a patient may rest in a prone or facedown generally horizontal position during treatment. Examination and treatment of numerous lumbar and lower thoracic spinal column disorders are facilitated by the numerous relative motions between upper body support section 15 and anterior support section 17, which are selectively available to the practitioner. For example, traction in the general direction of elongation of the patient's spinal column with the patient's ankles secured in stirrups 25 may be induced by rotation of crank handle 27. Lateral flexion, that is moving the lower support section 23 pivotally about support pedestal 11 in a horizontal plane, is achieved by releasing locking handle 29. Flexion, that is pivotal motion of lower body support section 17 about a horizontal axis, is facilitated by a pair of tension springs 31 which tend to oppose or counterbalance the weight of the patient's lower body section on section 23 with spring tension being under the control of handle 33 and selectable to match the weight of a particular patient. The lower body support section 17 may also be rotated about a generally longitudinal, horizontal axis passing approximately through the elevation of pivot 35. The relative motions between main body 15 and lower body, or anterior, support sections 17, as thus far discussed, are conventional and while present in both the applicant's presently preferred embodiment of the present invention and in the known prior art are optional to any particular embodiment of the present invention.

In the known prior art chiropractic treatment tables, the headpiece 19, including an upper headrest cushion, was formed either with cushions 37 and 21 as an integral one piece cushion or, in some cases, as two separate cushion portions, the headrest of which was pivotable only about a horizontal axis relative to the main body support section 15. The present invention provides a wide variety of relative motions or degrees of freedom to headpiece 19 relative to the main body support section 15. These motions may, of course, be employed in any practitioner selected combination, but will for clarity be discussed individually.

Cervical spine flexion in the form of an up and down headpiece pivotal motion about the horizontal axis 39 is best seen in FIG. 4 with certain details thereof illustrated in FIGS. 5, 10 and 12, as well as FIG. 1. Horizontal axis 39 is coaxial with that of bolt 41 passing through the end apertures of a clevis like U-shaped arm 43 and retained therein by nut 45. Thus, headpiece support bar 47 is pivotally supported near one end for rotation about horizontal axis 39. Such pivotal motion, as indicated by arrow 51, is opposed by compression spring 53 extending between knurled nut 55, which may be adjustably positioned along threaded shaft 57 and block 59 at the lower end of pivot column 61. During pivotal motion of the headpiece 19, rod 57 slides generally in its direction of elongation within the block 59 and such sliding motion may be arrested, thus locking headpiece 19 in some particular location by turning handle 63, tightening threaded shaft 65 against rod 57 as seen in FIG. 11. Central portion 69 remains free to rotate within block 59 to at least a limited degree for a purpose to be discussed subsequently, however, tightening of handle 63 essentially fixes the length of the diagonal brace created by rod 57, thus precluding further up and down headpiece motion.

The articulate coupling between headpiece 19 and main body support section 15, in addition to providing the above-discussed vertical flexion of the headpiece, also provides a lateral flexion or side to side motion for headpiece 19, generally about the vertical axis 71 of vertical column 61 as depicted in FIGS. 1, 4, 5, 10 and, most particularly, 13. Comparing FIGS. 10 and 13 it will be noted that the clevis like arm 43 is pinned to a vertically extending cylindrical post 73 by a cap screw 75 and that post in turn is fastened to the columnar member 61 by bolt 77. This, in essence, suspends the arm 43 and the structure supporting the diagonal bracing member 57 on a fixed extending arm 79 which, as seen in FIG. 1, is immovably fastened to the upper body support portion 15. As best seen in FIG. 13, the fixed support arm 79 is split, as at 81 and receives in one of the bifurcated portions thereof the threaded shaft portion 83 of the locking handle 85. Rotation of handle 85 in a direction to close the gap 81, tightens the grip of arm 79 about the post 73 to lock the headpiece 19 in a desired position, selected by the practitioner along an arc as indicated at 87 in FIG. 13.

A traction mode of motion is also available to the practitioner in which the headpiece 19 is movable linearly and generally horizontally along headpiece support bar 47 with FIGS. 1, 3, 4, 6 and 7 illustrating this adjustment scheme. The headpiece support bar 47 is a generally tubular member of square cross sectional configuration having a toothed rack 89 positioned therebeneath. Rack 89 is engaged along its lower toothed surface by a mating gear 91 fixed to shaft 93 extending outwardly to control knob 95 as best seen in FIG. 7. Rotation of the control knob 95 rotates gear 91 causing rack 89 to move linearly relative to the fixed gear support block 97 and support bar 47. Thus, rack 89 is fixed at its opposite ends to headrest support block 99 and headrest support block 101 with the two support blocks 99 and 101 surrounding the square cross sectional configured headpiece support bar and moving therealong with rack 89 as control wheel 95 and gear 91 are turned by the practitioner. Gear support block 97 does not move along headpiece support bar 47, but rather the rack 89 moves therethrough as the headpiece and its supporting blocks 99 and 101 traverse the headpiece support bar 47. Headpiece movement may be arrested at any desired location by tightening the hand wheel 103 which clamps a braking pad 105 against one side wall of the headpiece support bar 47, securing the headpiece at a desired location.

During chiropractic treatment of cervical problems, it is frequently desirable to impart a twisting or rotational motion to the patient's head. Such twisting motion should be generally about an axis corresponding generally to the axis of the patient's spinal column. Thus, in effect, a pure rotational movement is effected between adjacent vertebrae of the cervical spine portion. The arrangement for achieving this rotation about the spinal cord is illustrated primarily in FIGS. 2, 3, 6 and 8.

In FIG. 2*b* a patient's head 107 facing downwardly rests on the bifurcated cushion 37 and the patient's spinal cord axis is indicated generally at 109. It will be noted that axis 109 is generally horizontally extending longitudinally along the patient and, in particular, extends generally parallel to the headpiece support bar 47.

The headpiece and, in particular, the cushions 37 are connected to support bar 47 by an arrangement which allows limited arcuate movement of the headpiece about the axis 109, but without, of course, any direct coupling between the headpiece and axis 109. This coupling arrangement includes, as illustrated in FIG. 3, the cushion bases 113 and 115 which extend in pairs between the cushions and a pair of rocker or arcuate shaped members 117 of FIG. 3 and 119 of FIG. 8. The forward arc or rocker 117 includes an elongated slot 121 through which a shaft associated with locking knob 123 passes to threadingly engage the block 99, so that tightening of the locking knob clamps the arcuate member 117 to the block 99 precluding arcuate movement of the headpiece. Once knob 123 is loosened slightly, the headpiece, including the cushions 37 and members 113, 115, 117 and 119, are all free to move in a generally arcuate pattern rotating about axis 109 and with the slot 121 passing along the shaft associated with knob 123. A series of rollers are employed to constrain the arcuate members 117 and 119 to the appropriate arcuate path as best seen in FIGS. 3, 6 and 8. In FIGS. 3 and 6 it will be noted that the front portion of the headpiece and, in particular, the lowermost surface of arcuate rail 117 rests on a pair of rollers 124 and 125 which may be in the form of simple sleeve or roller bearings, free to rotate about the axis of centrally located screws, such as 127, which fasten the rollers to the block 99. The shaft of locking knob 123, which passes through slot 121 and into the threaded hole 129 in block 99, serves to hold the rail down in place on the rollers 124 and 125. As seen in FIG. 8, arcuate rocker 119 similarly supports the rest of the headpiece by engaging a similar pair of rollers 131 and 133, which are similarly mounted to the block 101. Arcuate rocker 119 is held down on the rollers 131 and 133 by a still further similar roller 135 engaging the upper surface of the arcuate member 119. To ensure that no unusual stress induces horizontal movement of the arcuate member 119 so as to disengage it from between rollers 135 above and rollers 131 and 133 below, a further L-shaped bracket 137 extends part way around and supports a still further similar roller 139 engaging the outside or front surface, as viewed in FIG. 8, of the arcuate member 119 retaining it in position between the three rollers 131, 133 and 135. Thus, with the arcuate rails 119 and 117 formed generally as portions of circles, the centers of those circles coincide with the axis of arcuate movement and with proper curvature of the rails will also coincide with the patient's spinal cord axis 109.

A fifth and last degree of freedom of headpiece movement is made available to the practitioner in the form of a so-called drop or abrupt downward translation of the headpiece away from the main body support portion 15 by employing the tubular sleeve and detent arrangement illustrated primarily in FIGS. 10 and 12. In FIG. 10 the elongated headpiece support bar 47 is permanently obliquely fastened, as by welding, to a hollow generally rectangular tubular sleeve 141, which surrounds and is free to slide along a similarly shaped rectangular post 143 received therein. Post 143 is affixed to the arm 43 so that sliding motion of sleeve 141 along post 143 corresponds to a downward and outward movement of the head support bar 47 relative to the main body support section of the table. This sliding motion is limited by the oblique extent of slot 145 and a similar slot on the opposite sleeve face which slots slide along the shaft bolt 41. The extreme upward positioning of sleeve 141 aligns hole 147 and detent ball 149, which under the urging of adjustably compressed coil spring 151 tends to retain the sleeve and thus the headpiece in its raised, rather than its dropped, position. The effect of the detent is under the control of a still further knurled knob 153 which may be tightened to essentially preclude any drop motion or may be loosened to a desired degree so that the practitioner may, at his option, exert a forward downward motion on the headpiece, causing that headpiece to suddenly drop away from the patient inducing a snapping action into the patient's cervical spine portion.

Thus, in summary, by loosening the adjustable locking device 85, the practitioner may pivot the headpiece in a horizontal plane about the vertical axis 71. By loosening the locking device 63, the practitioner may, relying somewhat on the counterbalancing effect of compressed spring 53, pivot the headpiece in a vertical plane about the horizontal axis 39. By loosening the locking arrangement associated with knob 103, the practitioner may turn knob 95 inducing linear motion to the rack 87 and therefore exerting spinal cord traction on the patient. By loosening the locking knob 123, the practitioner may rotate the headpiece and the patient's head resting thereon substantially about the axis of the patient's spine as depicted sequentially in FIGS. 2*a*, 2*b* and 2*c*. Lastly, by loosening somewhat the detent control 153 the practitioner may induce a limited, abrupt downward translation to the headpiece when desired. It is during this last motion that the diagonal bracing rod 57 executes a slight rotational movement in the plane of FIG. 1 and, for this reason, a slight amount of pivotal motion is allowed between the block 59 and rod 57 as discussed in conjunction with FIG. 10, even though the locking device 63 is securely tightened precluding any linear motion of rod 57.

From the foregoing it is now apparent that a novel, articulate coupling between a headpiece and a main body support section of a chiropractic treatment table, allowing a wide variety of practitioner induced movements, as well as a novel method of treating a patient having a disorder of the cervical curve portion of the spinal column, have been disclosed meeting the objects and advantageous features set out hereinbefore, as well as others, and that modifications as to the precise configuration, shapes and details may be made by those having ordinary skill in the art without departing from the spirit of the invention or the scope thereof as set out by the claims which follow.

What is claimed is:

1. In a chiropractic treatment table of the type having a support pedestal, an upper body support section resting on the support pedestal, an anterior portion extending from the support section for supporting a lower portion of a patient's body, and a headpiece extending from the support section in a direction generally opposite the anterior portion and upon which a patient's head may rest with the patient in a prone position spanning the headpiece, support section and anterior portion, the improvement comprising means articulately coupling the headpiece to the support section and selectively providing relative thereto at least two degrees of freedom of headpiece movement, said headpiece having a longitudinal dimension sufficient to support only the patient's head, said upper body support section having a longitudinal dimension sufficient to support only the upper body portion of the patient and said anterior portion having a longitudinal dimension sufficient to support only the lower body portion of the patient, said coupling means including means for selectively abruptly translating the headpiece obliquely downward and away from the support section a limited distance, and detent means precluding inadvertent abrupt translation.

2. The improvement of claim 1 wherein the articulate coupling provides pivotal motion of the headpiece selectively about a generally horizontal axis and about a generally vertical axis.

3. The improvement of claim 1 further comprising an elongated headpiece support bar, the articulate coupling means pivotally interconnecting the bar and support section, and means for selectively moving the headpiece linearly along the support bar providing a traction mode of patient treatment.

4. The improvement of claim 1 further comprising an elongated headpiece support bar, the articulate coupling means pivotally interconnecting the bar and support section, and means joining the headpiece to the support bar and allowing therebetween selective limited arcuate movement generally about an axis displaced from and generally parallel to the elongated bar.

5. The improvement of claim 4 wherein the arcuate movement axis generally coincides with the cervical portion of a patient's spine when resting prone on the table.

6. The improvement of claim 4 wherein the joining means comprises a pair of arcuate rails fixed to the headpiece and a pair of rail receiving fixtures on the support bar along which the rails may move.

7. The improvement of claim 6 wherein the arcuate rails are formed in the general configuration of portions of circles the centers of which coincide with the axis of arcuate movement.

8. The improvement of claim 7 wherein each fixture comprises a plurality of rail engaging rollers.

9. The improvement of claim 1 wherein the coupling means provides five degrees of freedom of headpiece movement relative to the support section.

10. The improvement of claim 9 wherein the headpiece movements include an arcuate motion about a generally horizontal axis generally coinciding with the cervical portion of the spine of a patient in a prone position on the table.

11. The improvement of claim 9 wherein the headpiece movements consist of pivotal motions about transverse horizontal and vertical axes, rotation about a longitudinal generally horizontal axis and, linear motion along the longitudinal generally horizontal axis.

12. The improvement of claim 1 further comprising a plurality of individually actuable locking devices one each associated with each of the respective headpiece movements and each when actuated to a locking condition precluding the associated headpiece movement and reducing by one the number of degrees of freedom of headpiece movement.

13. In a chiropractic treatment table of the type having a patient supporting generally horizontal upper surface including at least head support and body support sections for supporting a patient facedown in a generally horizontal attitude, said head support section having a longitudinal dimension sufficient to support only the patient's head, an improved mechanical coupling between the head and body support sections selectively allowing therebetween limited rotational motion about a longitudinal axis located above the support sections and in a general alignment with the patient's spine, said coupling means further including means for selectively abruptly translating the head support section obliquely downward and away from the body support section a limited distance.

14. The improvement of claim 13 wherein the mechanical coupling includes an elongated longitudinal support bar articulately coupled near one end thereof to the body support section, a pair of arcuate rails fixed to the head support section, and a pair of rail receiving fixtures on the support bar along which the rails may move.

15. The improvement of claim 14 wherein the arcuate rails are formed in the general configuration of portions of circles the centers of which coincide with the longitudinal axis.

16. The improvement of claim 16 wherein each fixture comprises a plurality of rail engaging rollers and one of the fixtures includes a manually actuable clamp for selectively securing a rail section to the fixture and therefore also fixing the rotational orientation of the head support section.

17. The improvement of claim 16 further comprising means for selectively moving the head support, arcuate rails, and fixtures longitudinally along the support bar.

18. A method of treating a patient having a disorder of the cervical curve portion of the spinal column comprising the steps of:

supporting the patient in a generally horizontal face-down attitude on a chriopractic treatment table with the patient's body resting on a first table portion and the patient's head resting on a second table portion which is selectively movable relative to the first table portion; and simultaneously moving the patient's head and the second table portion relative to the patient's body and the first table portion, with the head and body continuously remaining supported by the second and first table portions respectively, through the relative motion of an abrupt oblique linear translation of the patient's head downward and away from the patient's upper body, to impart a stretching and forward snapping action to a cervical portion of the patient's spine.

* * * * *